US006484115B1

(12) United States Patent
Freymond et al.

(10) Patent No.: US 6,484,115 B1
(45) Date of Patent: Nov. 19, 2002

(54) METHOD OF CORRECTING THE PRE-PROGRAMMED INITIATION OF AN EVENT IN A SPIN-STABILIZED PROJECTILE, DEVICE FOR EXECUTING THE METHOD AND USE OF THE DEVICE

(75) Inventors: Pierre H. Freymond, Zollikon (CH); Klaus Muenzel, Klingnau (CH)

(73) Assignee: Oerlikon Contraves Pyrotec AG, Zurich (CH)

( * ) Notice: Subject to any disclaimer, the term of this patent is extended or adjusted under 35 U.S.C. 154(b) by 0 days.

(21) Appl. No.: 09/413,793

(22) Filed: Oct. 7, 1999

(30) Foreign Application Priority Data

Oct. 8, 1998 (CH) ..... 2032/98

(51) Int. Cl.[7] ..... E42C 11/04

(52) U.S. Cl. ..... 702/104; 702/41; 702/79; 702/85; 702/108; 702/142; 702/189

(58) Field of Search ..... 702/41–43, 75–77, 702/79, 85, 89, 96, 106, 108, 124, 125, 126, 142, 143, 145–147, 149, 176–178, 183, 187, 188, 189, FOR 107, FOR 108, FOR 126, FOR 130, FOR 134, FOR 135, FOR 150, FOR 151, FOR 155–163, FOR 170, FOR 171; 89/6, 6.5; 102/293, 501; 244/3.1, 3.23; 235/407, 408, 417; 73/1.01, 167; 324/160, 166, 173

(56) References Cited

U.S. PATENT DOCUMENTS

| | | | | | |
|---|---|---|---|---|---|
| 3,685,159 | A | * | 8/1972 | Erhard | 33/238 |
| 3,844,217 | A | * | 10/1974 | Ziemba | 102/70.2 R |
| 3,919,642 | A | * | 11/1975 | Allen | 325/113 |
| 3,955,069 | A | * | 5/1976 | Ziemba | 235/92 PE |
| 4,022,102 | A | | 5/1977 | Ettel | 89/6.5 |
| 4,229,741 | A | * | 10/1980 | Groth, Jr. | 370/24 |
| 4,283,989 | A | * | 8/1981 | Toulios et al. | 89/6.5 |
| 4,664,013 | A | | 5/1987 | Wegner et al. | 89/6.5 |
| 4,686,882 | A | | 8/1987 | Bai | 89/6.5 |
| 4,777,352 | A | * | 10/1988 | Moore | 235/404 |
| 4,955,279 | A | * | 9/1990 | Nahrwold | 89/6.5 |
| 5,191,163 | A | * | 3/1993 | Wallwey et al. | 89/6 |
| 5,343,795 | A | * | 9/1994 | Ziemba et al. | 89/6.5 |
| 5,413,029 | A | * | 5/1995 | Gent et al. | 89/41.3 |
| 5,497,704 | A | * | 3/1996 | Kurschner et al. | 102/264 |
| 5,661,555 | A | * | 8/1997 | Romer et al. | 356/139.03 |
| 5,787,785 | A | * | 8/1998 | Muenzel et al. | 89/6.5 |
| 5,814,755 | A | * | 9/1998 | Boss | 89/6.5 |
| 5,814,756 | A | * | 9/1998 | Boss | 89/6.5 |
| 5,834,675 | A | * | 11/1998 | Boss | 89/6.5 |
| 6,216,595 | B1 | * | 4/2001 | Lamorlette et al. | 102/270 |

FOREIGN PATENT DOCUMENTS

| | | | |
|---|---|---|---|
| EP | 0661516 | | 7/1995 |
| EP | 0802390 | | 10/1997 |
| GB | 1129448 | | 10/1968 |
| GB | 2236925 | A * | 4/1991 |

* cited by examiner

*Primary Examiner*—Marc S. Hoff
*Assistant Examiner*—Carol S. W. Tsai
(74) *Attorney, Agent, or Firm*—Browdy and Neimark, P.L.L.C.

(57) ABSTRACT

A method for correcting a pre-programmed time of disaggregation of a spin-stabilized projectile. For this purpose the deviation of the actual muzzle velocity from the theoretical muzzle velocity is taken into consideration. The actual muzzle velocity is determined with the aid of the effects of a magnetic field on the projectile indirectly by means of the actual rotation frequency of the projectile, wherein the actual rotation frequency of the projectile is determined during a time-limited calibration phase directly following the firing of the projectile. The device for executing this method includes means for storing the time of initiation, programmed on the basis of the theoretical rotation frequency of the projectile, means for determining the actual rotation frequency of the projectile, and means for correcting, or respectively updating of the theoretical time of initiation toward the actual time of initiation on the basis of the actual rotation frequency, or respectively muzzle velocity of the projectile. The employment of the device is intended to increase the effectiveness of a weapons system for attacking targets by means of fuse-time-fixed projectiles.

15 Claims, 3 Drawing Sheets

Figure 1:
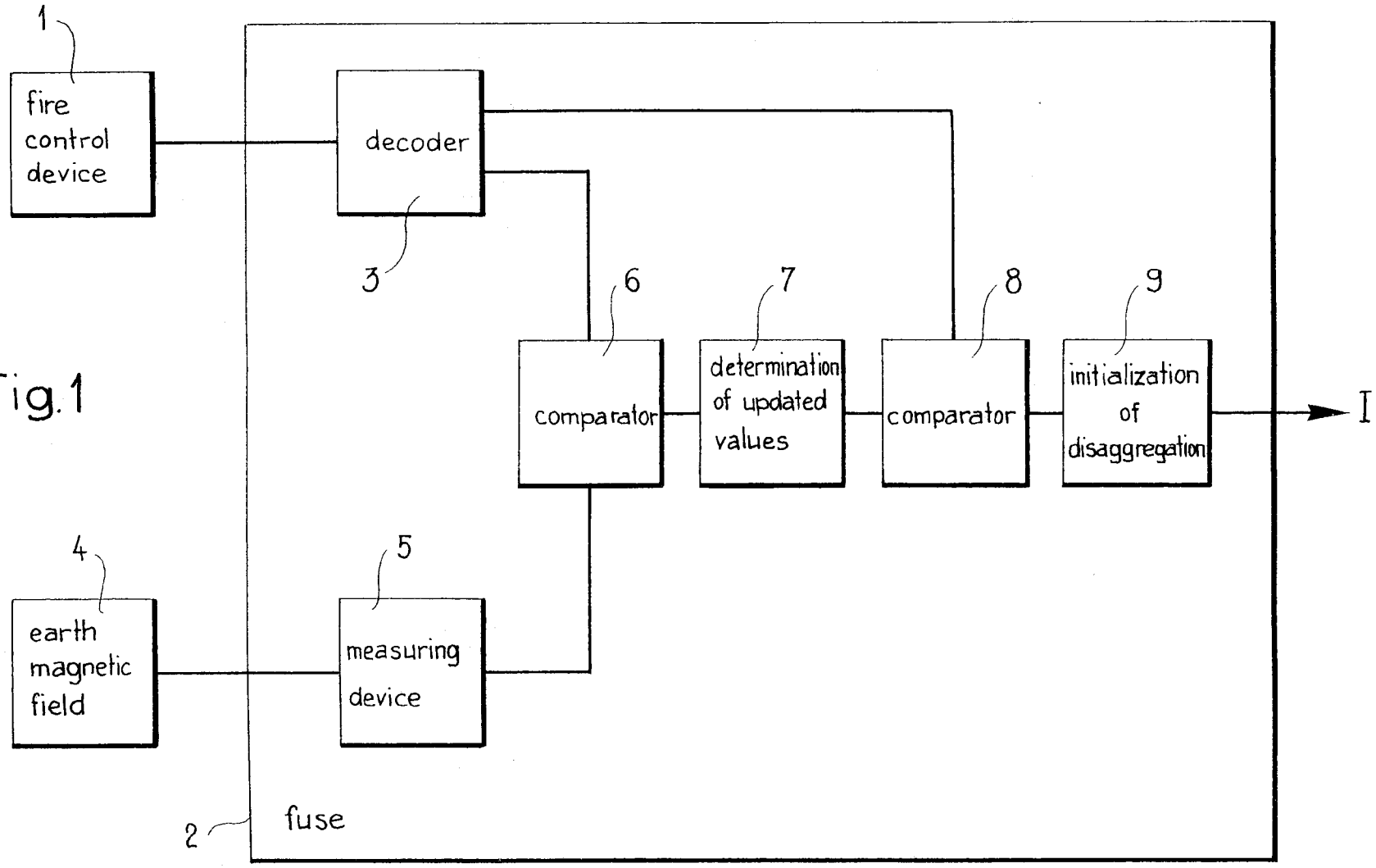

METHOD OF CORRECTING THE PRE-PROGRAMMED INITIATION OF AN EVENT IN A SPIN-STABILIZED PROJECTILE, DEVICE FOR EXECUTING THE METHOD AND USE OF THE DEVICE

FIELD OF THE INVENTION

The invention relates to a method for correcting the pre-programmed initiation of an event in a spin-stabilized projectile, a device for executing the method, and a use of the device.

REVIEW OF RELATED TECHNOLOGY

Methods and devices of this type are used in connection with the chronologically pre-programmed initiation of functions in a spin-stabilized ballistic projectile, wherein initiation of the function is intended to take place at a defined initiation place and therefore at a defined initiation distance from the launch location, or respectively at a defined initiation time, and therefore after a defined length of flight. The function which is to be initiated in this way can be any arbitrary function; with ballistic projectiles the time of disaggregation into partial projectiles, or respectively of fragmentation, is generally determined in this manner.

It has been long known in connection with projectiles of different types, i.e. not only ballistic projectiles, to utilize a time fuse with a fixed or adjustable initiation time for determining the initiation time, wherein projectiles with time fuses with adjustable timing are designated as so-called fuse-time-fixed projectiles.

In principle, two types of time-fixed fuses can be used in spin-stabilized projectiles, namely time fuses and rotary fuses. With time fuses, the disaggregation is initiated at the end of a defined, or respectively definable time interval which, for example, starts at launch; with rotary fuses, disaggregation is initiated after a defined, or respectively definable number of revolutions which the projectile has performed since the launch.

Several methods are known for setting the time fuse, or respectively for the so-called fuse-time-fixing of fuse-time-fixed projectiles. In this case a basic distinction needs to be made between projectiles, wherein fuse-time-fixing takes place in a defined manner prior to launch on the basis of theoretical calculations, and projectiles, wherein fuse-time-fixing takes place after the launch, wherein deviations from theoretically calculated values, for example for the disaggregation location, the disaggregation time, the muzzle velocity or, if required, the final angle of twist, can be taken into consideration. The variation range of one of these parameters, for example of the muzzle velocity or of the final angle of twist, normally lies in a range of less than 5%.

With projectiles which can be fuse-time-fixed during flight, it is possible to provide the fuse with the time of disaggregation by remote signaling, for example. However, such devices have various disadvantages; for one, they require an elaborate implementation of a receiver, and secondly, there is the danger of enemy interference with the remote signaling processes, which can result in incorrect fuse-time-fixation. These disadvantages are so serious that it is therefore often preferred to provide only a pre-programmed fuse-time-fixation, which is not affected anymore during flight, so that no remote signaling connection is required.

Pre-programmed rotary fuses are pre-programmed, preferably during loading, in such a way that ignition takes place after a defined, preset number of revolutions of the projectile. However, without corrective measures, such pre-programming has comparatively inaccurate results, since it cannot take the into consideration deviations, based on the actual flight characteristics of the projectile, from the theoretically determined flight characteristics.

It is known to everyone skilled in the art that the muzzle velocity is an essential value determining the flight characteristics of the projectile. Generally, the effective muzzle velocity deviates for various reasons from the theoretically calculated muzzle velocity, which has the result that the effective location/time of the disaggregation of the projectile differs from the desired location/time of the disaggregation which, for example, had been theoretically determined.

To prevent, or at least limit, such deviations, while still not providing an elaborate remote signaling device, various steps can be taken which are based on detecting the effective frequency of revolutions of the projectile and/or the effective muzzle velocity of the projectile, which is correlated with the effective frequency of revolutions, and including them internally in the projectile in determining the time-fixed fuse time.

Various methods are known for determining the effective muzzle velocity.

For example, the effective muzzle velocity can be detected on the outside of the gun barrel closely near its muzzle by means of a coil arrangement with two spaced-apart measuring coils. However, such measuring coils are comparatively delicate and constitute a particularly endangered component, at least with mobile guns.

The effective muzzle velocity can also be determined by extrapolation from a projectile velocity measured inside the gun barrel in the area of its muzzle cross section. Here, measurement is performed with the aid of two sensors, which are arranged at a defined mutual distance from each other. The disadvantage is that comparatively elaborate devices at the gun barrel are required for executing this method, and that the results are not very accurate as a result of the extrapolation.

In order to avoid the disadvantages of the above mentioned methods for determining the actual muzzle velocity, attempts are also made to determine the actual muzzle velocity of the projectiles after they have been fired, but without additional devices at the gun barrel.

Since there is a fixed connection between the projectile velocity and the frequency of projectile rotation in the flight phase immediately following firing, attempts are made to correlate the time of the disaggregation of the projectile, instead with the projectile velocity, with the corresponding number of revolutions made by the projectile in the course of its flight along its trajectory.

Counting of the rotations of the projectile is performed with the aid of the earth magnetic field in conventional methods of this type. The fuse has a counter, which continuously integrates the number of the projectile revolutions. By means of the spin of the projectile, for example its rotation essentially around the longitudinal axis of the projectile, a voltage is induced inside the fuse, for example in a coil arranged for this, by means of the earth magnetic field, which extends sine-like over time. The counter continuously, i.e. during the complete duration of the flight of the projectile, adds up the number of pulses between two crossovers of this voltage in the same direction. With a fuse which, as mentioned above is called a rotary fuse, ignition, or respectively the disaggregation of the projectile takes place as soon as the number of added-up pulse s has reached a pre-programmed value.

This method has several disadvantages. Counting of the revolutions of the projectile takes place either during its entire time in flight, or only directly following its firing, but with a check afterwards, for example after 80% of the approximate time in flight. Since the voltage induced by the earth magnetic field is only usable if it is amplified, and since energy is needed for this amplification, it is necessary to provide a considerable amount of energy for this amplification because of the comparatively long use of the earth magnetic field Furthermore, interferences with the voltage process induced by the earth magnetic field and of the values derived therefrom can be caused by interfering enemy transmission; the effects of these interferences are the more important, the longer the use of the earth magnetic field lasts.

For example, a multi-functional fuse for spin-stabilized projectiles has become known from EP 0 661 516 A1, wherein the actual muzzle velocity is calculated on the basis of the actual frequency of rotation of the projectile. The earth magnetic field is used for determining the frequency of rotation, wherein each rotation of the projectile provides a pulse. The number of rotations is counted during a defined period of time, which is determined by an oscillator inside the projectile in that the number of the rotations of the projectile are added up. The actual muzzle velocity is determined here in accordance with the following equation (1):

$$V0s=(N1s*\pi*Ds)/(Ts*tg(\phi es)) \quad (1)$$

The indices "t" were inserted into this equation in order to make it clear that the terms used therein are those which were obtained from the prior art as described by the mentioned EP 0 661 516 A1, and in order to prevent mixups with the designation of further equations relating to the invention The meanings in equation (1) are VOs the muzzle velocity calculated on the basis of the measurement Ts the measuring time N1s the measured number of rotations of the projectile φes the final angle of twist Ds the caliber Tg the tangential function Inter alia, it is proposed in EP 0 661 516 A1 to perform the continuous determination of the length of flight, or respectively of the trajectory, during a first flight phase of approximately 1000 meters by means of the rotation of the projectile; at the beginning of a second flight phase, starting approximately after 1000 meters, a change should then be made from counting the rotation to counting the time, since it is said to have been shown that, although the accuracy of rotary fuses is quite good over flight distances up to 1000 meters, at greater flight distances it was inferior to the accuracy of time fuses.

Thus, the earth magnetic field is used for the continuous counting of the projectile revolutions during the comparatively long first flight phase of 1000 meters, or respectively during the amount of time required for flying over this distance. Interferences with the earth magnetic field therefore can affect the counting over a very long time and greatly compromise the function of the fuse.

OBJECTS AND SUMMARY OF THE INVENTION

Thus, the object of the invention is seen in proposing an improvement of the method of the type mentioned at the outset, by means of which the disadvantages of the prior art are prevented, producing a device for executing this method, and proposing a use for this device.

It is pointed out here that the novel method in accordance with the following description is based on effects resulting in projectiles because of the actions of a magnetic field, wherein the earth magnetic field is always mentioned as example, however, corresponding effects can also be caused by other, i.e. artificially created, magnetic fields.

It is moreover pointed out that in what follows reference will be made to the initiation of the disaggregation of a projectile, however, the disaggregation is only an example of the pre-programmed events in projectiles which can be corrected in accordance with the method of the invention.

In accordance with the invention, the measurement for determining the frequency of rotation of the projectile only takes place during a comparatively brief period of time immediately following the firing of the projectile, which is called the calibration phase. The novel method provides comparatively good results, because during the calibration phase the projectile velocity differs only to a very small degree from the muzzle velocity determined on the basis of the frequency of rotation of the projectile. It is furthermore advantageous that the effects of interferences of the earth magnetic field remain small, since it only takes effect during the relatively short calibration phase. A further advantage of the chronological limitation of the use of the earth magnetic field by the invention lies in that the energy needed for signal amplification in the fuse is low.

Following the calibration phase, everything else inevitably occurs in the projectile, or respectively without the possibility of exerting any influence from the outside. Although the novel method is therefore not an iterative method, since no attempts to affect the events in the fuse after the calibration phase, for example in order to take into consideration newly occurring meteorological effects or changes in the flight path of the targets, it is still comparatively accurate, since the ballistic behavior of the projectiles and of the targets in flight within the comparatively short time periods of the length of flight is sufficiently known or then becomes unimportant.

It is easy to understand that the details of the calculations required for executing the method in accordance with the invention can be performed in different ways, or respectively with the aid of different devices.

By means of the method in accordance with the invention the calibration phase is preferably calculated, namely in such a way that the overall error from the relevant unavoidable errors becomes as small as possible. The performance of such a calculation will be described in what follows. The prerequisites and simplifications performed in the course of such a calculation do of course affect its accuracy. As usual, greater accuracy must be paid for with a larger outlay.

The accuracy of the determination of the muzzle velocity essentially is a function of the number of rotations of the projectile during which the measurement, or respectively counting of the pulses of the oscillator, or respectively frequency generator, inside the projectile takes place. If measuring is performed during a large number of rotations of the projectile, the measuring method per se is more accurate, since the influence of uncounted pulses, in particular at the start and the end of the measurement, is relatively reduced. Thus, in order to keep the errors of the measurement method small, measurement during a large number of rotations of the projectile is advantageous. However, along with the number of the rotations of the projectile the length of time during which the projectile moves forward is also increased, wherein it loses velocity and frequency of rotation, which also results in an error which could only be corrected by means of a considerable computing outlay. In order to keep the error connected with the reduction in velocity small, the measurement of the least possible number of rotations of the projectile is therefore advantageous. Since the first-mentioned error is reduced with an increasing number of rotations of the projectile, but the second error mentioned increases with an increasing number of rotations, there is an optimal number of rotations of the projectile at which the sum of the mentioned errors, or respectively the overall error, is minimal. This optimal number of rotations of the projectile is determined by means of the following calculation.

In this case it is assumed that the use of the earth magnetic field takes place in the sense that the number of pulses from a pulse generator, or respectively oscillator, inside the projectile is measured, or respectively added up, in the course of a defined number of rotations of the projectile. However, it is pointed out that other methods are also possible for determining the effective frequency of rotation or the effective muzzle velocity of the projectile, while making use of the earth magnetic field, and that the progress achieved by means of the invention is not intended to be limited to this measuring, or respectively calculation method, but is to be seen as the large reduction of the period of time during which the earth magnetic field is used.

The first relative error is determined as follows: an oscillator with a fixed oscillator frequency inside the projectile provides M pulses while the projectile performs a defined number of rotations, wherein M is calculated in accordance with the following equation (2):

$$M=(fz*\pi*D*R)/(V0*tg(\phi e)) \quad (2)$$

The following meanings apply in respect to equation (2) and further equations:

M the number of counted pulses of the oscillator inside the projectile

R the number of rotations of the projectile during which the pulses of the oscillator are counted VO the actual muzzle velocity e the final angle of twist D the caliber fz the constant frequency of the frequency generator, or respectively oscillator, inside the projectile tg the tangent function.

If ΔM pulses are not counted during the count, the relative first error is $$\Delta M/M=((\Delta M*V0*tg(\phi e))/(fz*\pi*D))*1/R \quad (3)$$

Thus, as ascertained above, the first relative error decreases with increasing R.

The second relative error relates to the deviation of the trajectory, or respectively the time in flight, from the theoretical value, and is calculated in accordance with the following equation (4):

$$\Delta s/s=((\pi*D*(a-k))/(2*tg(\phi e)))*R \quad (4)$$

The following meanings apply:

s the distance theoretically traveled by the projectile

Δs the difference between the distance theoretically traveled by the projectile and the actually traveled distance (2a−k) a correction term, wherein a is the Antonio factor.

Thus, as ascertained above, the second relative error increases with increasing R.

The relative overall error, which is identified by therefore is in accordance with equation (5):

$$\epsilon=\Delta M/M+\Delta s/s=((\Delta M*V0*tg(\phi e))/(fz*\pi*D))*1/R+((\pi*D*(2a-k))/(2*tg((\phi e)))*R \quad (5)$$

In order to find that optimal value of the projectile revolutions Ropt, at which is minimal, ϵ is differentiated toward R, and the result of this differentiation, i.e. dϵ/dR, is set to zero. The R which can be calculated from this corresponds to the sought after Ropt.

$$d\epsilon/dR=-1/R^2*((\Delta M*V0*tg((\phi e))/(fz*\pi*D))+((\pi*D*(2a-k))/(2tg((\phi e)))=0 \quad (6)$$

$$Ropt^2=(tg(\phi e))/(\pi*D))^2*(2*V0*\Delta M)/(fz*(2a-k)) \quad (7)$$

Ropt is finally found by finding the root from $Ropt^2$. It is not possible to define an Ropt of the type of an invariable characteristic number. Even by means of the simplifications made on the basis of this, Ropt can only be calculated while taking the respective geometric conditions, such as the caliber D and the final angle of twist e, as well as the respective muzzle velocity VO, into consideration.

The above calculation of Ropt took place by means of several simplifications. In particular, in the equation for the factors by which 1/R, or respectively R, are multiplied, are considered to be constant, which in actuality only applies directly following firing. The following exemplary calculation of Ropt for a usual case will show, however, that Ropt is so small, that the mentioned simplifications are tolerable within the scope of the accuracy of the entire method. By means of M=2 pulses fz=1 MHz VO=1050 m/sec (2a−k)=71.2*1/1 000 000

D=35 mm

ϕe=6.5 the value $$Ropt=8 \text{ rotations of the projectile}$$

is obtained for the optimal number of rotations of the projectile, during which the pulses of the oscillator should be counted.

Here, eight rotations of the projectile correspond to a distance of approximately 10 meters, which the projectile travels on its trajectory. In this exemplary case the earth magnetic field is therefore used in accordance with the above calculation over a trajectory of approximately 10 meters. But with the known method, the earth magnetic field is used over a trajectory of 1000 meters, i..e a distance 100 times longer, and therefore over a period of time which is more than 100 times longer. It is obvious that the method of the invention is much more accurate than the known method, because the drop in velocity is unimportant during the limited number of rotations of the projectile, and since an interference with the earth magnetic field has an effect only during a very limited calibration phase and therefore results in considerably smaller errors than with the known method. This even applies when it is considered that the above calculation contains numerous simplifications and inexactnesses.

As already mentioned several times, the earth magnetic field is used in connection with the novel method, the same as with conventional methods, for determining by way of the effective rotation frequency of the projectile the effective muzzle velocity of the projectile. The conventional method operates in such a way that each rotation of the projectile provides a pulse, and that the rotations of the projectile are counted during a defined time interval, which is determined by an oscillator inside the projectile, by adding up the pulses caused by the rotation of the projectile. The actual muzzle velocity is here determined in accordance with equation (1). The muzzle velocity VOs calculated in this way is directly proportional to the measured value, i.e. to the measured value of the number of rotations of the projectile. In spite of this, this measuring method is not very accurate because of the low resolution. In contrast thereto, in accordance with the invention the following procedure is preferably followed, wherein the pulses of a frequency generator, or respectively oscillator, inside the projectile are measured, or respectively counted, over a defined number of rotations of the projectile, and the calculation of the actual muzzle velocity is then performed in accordance with the following equation (8):

$$V0=(fz*\pi*D)/(tg(\phi e)*R) \quad (8)$$

Because of the better resolution, more accurate results are obtained by means of this preferred variation of the novel method than with the known method, although the muzzle velocity to be calculated is only indirectly proportional to the measured value, i.e. the measured, or respectively added up, number of pulses of the oscillator inside the projectile.

The number of pulses of the frequency generator per rotation of the projectile are measured, or respectively added up, in that the change of the position of the projectile, i.e. the rotation of the projectile, is determined in the course of its rotation by means of the change in a voltage in a suitably placed coil arrangement in the projectile, which voltage is induced by the earth magnetic field. It should again be mentioned here that in place of the physical properties of the earth magnetic field, it is also possible to use the physical properties of another magnetic field for determining the rotation of the projectile.

As already mentioned, the approximate relationship VO/VO<5% applies for the deviation of the actual muzzle velocity from the theoretical muzzle velocity. In a simplifying way it is assumed for the further calculations that the resistance value for the projectile, which per se is a function of the velocity, is constant, which is permissible because of the mentioned relationship.

BRIEF DESCRIPTION OF THE DRAWING FIGURES

Figure 2:
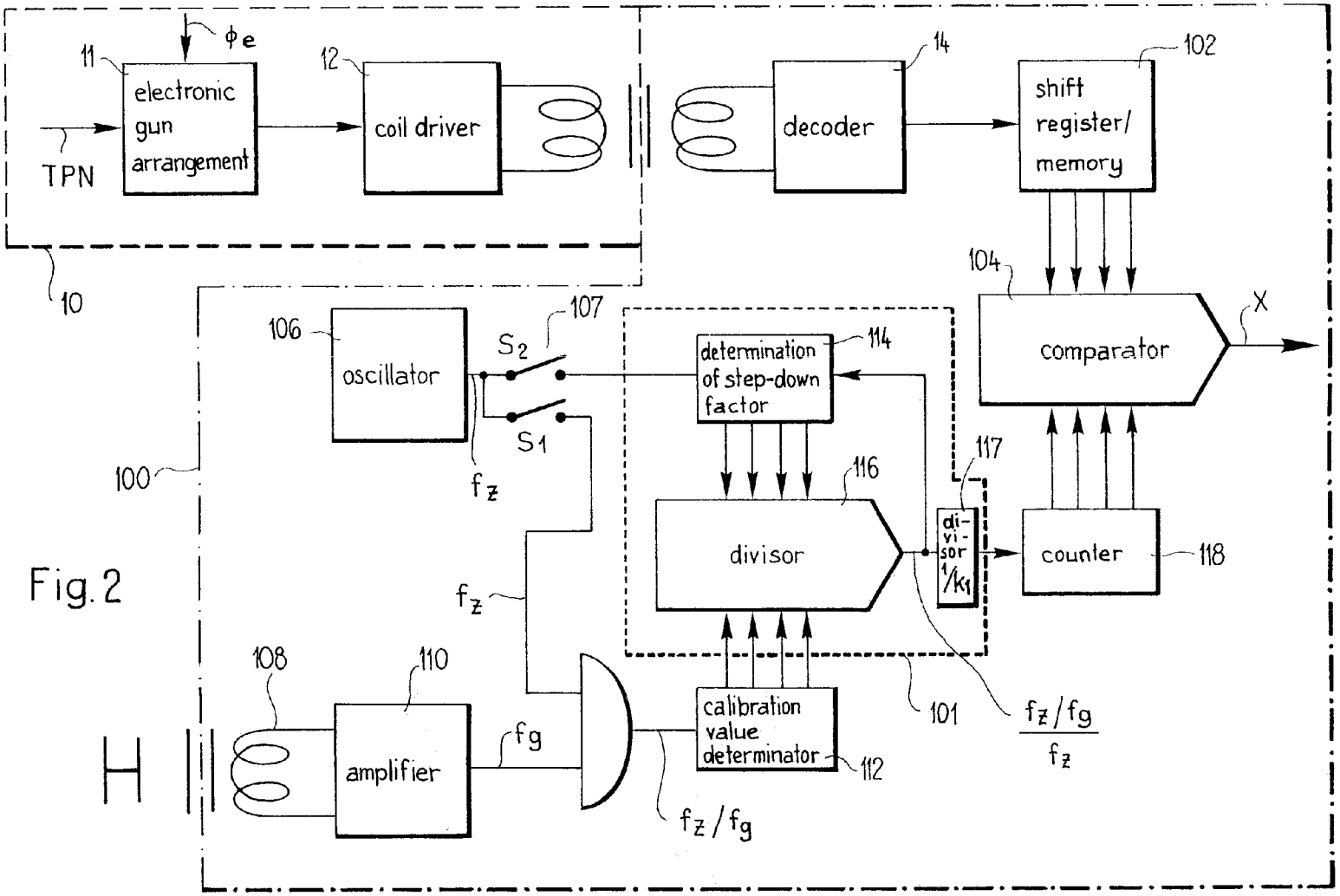
Figure 3:
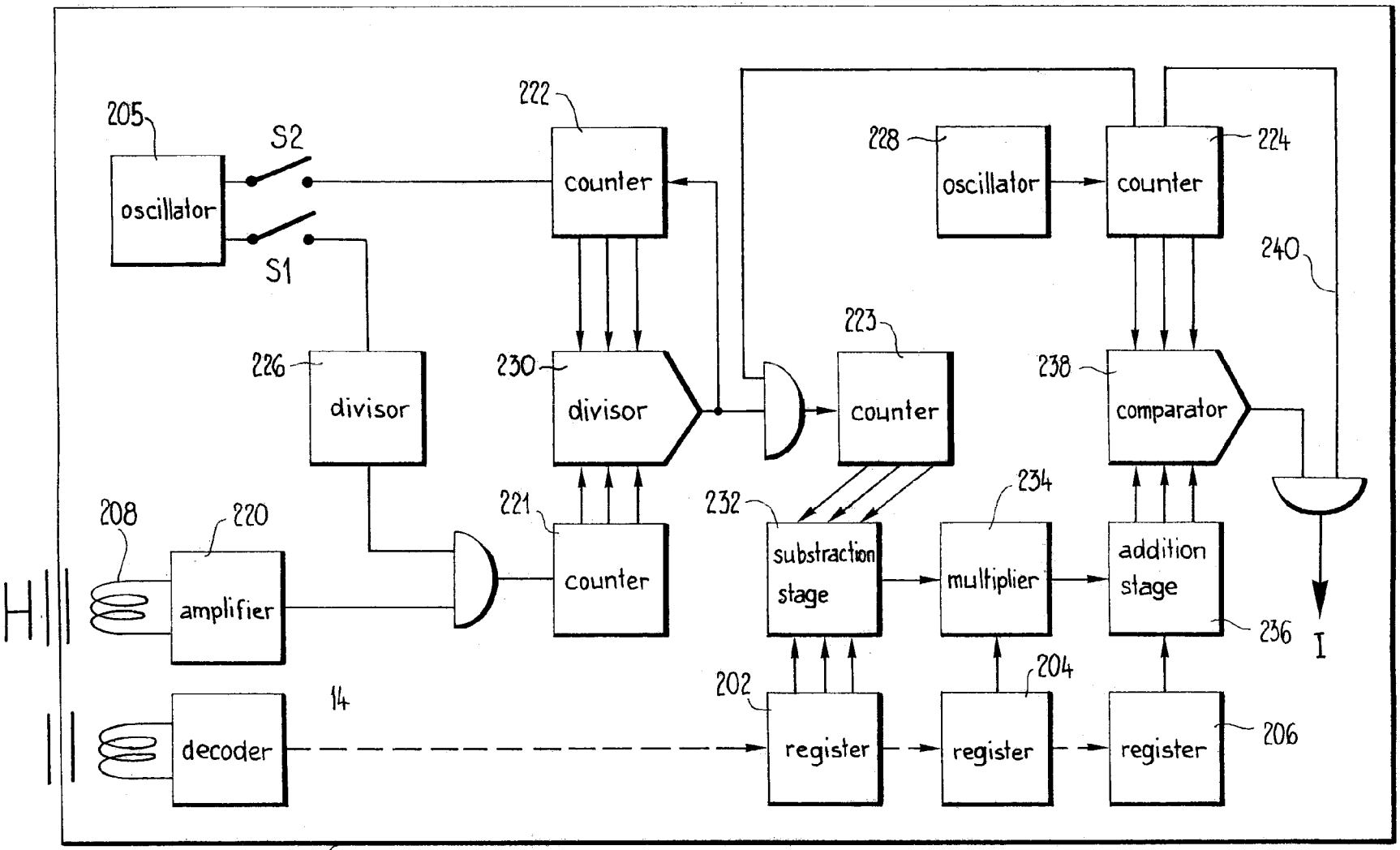

The invention will be described in greater detail in what follows by means of exemplary embodiments and by making reference to the drawings. Shown are in:

FIG. 1, the method in accordance with the invention in a schematic representation;

FIG. 2, a first exemplary embodiment of the invention in a schematic representation;

FIG. 3, a second exemplary embodiment of the invention in a schematic representation.

DETAILED DESCRIPTION OF THE PREFERRED EMBODIMENTS

At the outset it should be mentioned that all numerical data mentioned in the present specification should be merely considered to be examples, which within the scope of the invention can be changed within defined limits in accordance with the respectively prevailing conditions.

For detecting the earth magnetic field, a coil arrangement is generally used, in which the earth magnetic field induces a voltage, which changes in a sine shape with the rotation of the projectile itself. However, for making use of the earth magnetic field it is also possible to employ another suitable devices, for example magnetic sensors, such as Hall elements or field plates, in place of a coil.

The following designations and mathematical relations will be used in what follows for explaining the invention:

TPN: programmed time of the disaggregation, or respectively standard disaggregation time, which is determined by taking into consideration the theoretical muzzle velocity, or respectively, frequency of rotation, and on the basis of the theoretical final angle of twist VON: theoretical muzzle velocity, or respectively standard muzzle velocity φen: theoretical final angle of twist, or respectively standard final angle of twist, of the projectile at the muzzle TP: actual, or respectively updated, time of disaggregation VO: actual, or respectively updated, muzzle velocity φe: actual final angle of twist D: caliber fz: constant oscillator frequency tg: tangent function fgn: theoretical frequency of rotation, or respectively standard frequency of rotation of the projectile at the muzzle; the following applies:

$$f_{gn}=(V0N*tg(\phi en))/(\pi*D) \quad (9)$$

fg: actual frequency of rotation of the projectile at the muzzle; the following applies:

$$fg=(V0*tg(\phi e))/(\pi*D) \quad (10)$$

TGN : theoretical period of time, or respectively standard period of time, for a rotation of the projectile at the muzzle; the following applies:

$$TGN=1/fgn=\pi*D/(V0N*tg(\phi en)) \quad (11)$$

TG: actual period of time for a rotation of the projectile at the muzzle; the following applies:

$$TG=1/fg=\pi*D/(V0*tg(\phi e)) \quad (12)$$

N1N : theoretical number, or respectively standard number, of pulses of the oscillator in the course of one rotation of the projectile at the muzzle, the following applies:

$$N1N=fz/fgn=fz*TGN \quad (13)$$

N1: actual number of pulses of the oscillator in the course of one rotation of the projectile at the muzzle, the following applies:

$$N1=fz/fg=fz*TG \quad (14)$$

xO: length of rotation, i.e. length of the trajectory which the projectile travels along the trajectory immediately past the muzzle during a rotation of the projectile; xO is invariable with the muzzle velocity VO; the following applies:

$$x0=(\pi*D)/(tg(\phi e))=1/K1 \quad (15)$$

FIG. 1 schematically represents a fire control device 1 as well as a fuse 2 of a projectile, not further shown in detail. From the fire control device 1, the fuse 2 receives via a decoder 3 through an electronic gun arrangement an input with the standard muzzle velocity, or respectively the standard frequency of rotation, and the standard fin al angle of twist or, if required, the actual final angle of twist, which had been determined and entered in another way, as well as data regarding the movements of the aerial target which is intended to be hit by the projectile, by means of which the fuse-time-fixation, or respectively the theoretical standard disaggregation time, is determined. A measuring device 5, employing the earth magnetic field 4, is used for the autonomous measurement of the effective frequency of rotation of the projectile immediately after the muzzle. The result of the autonomous measurement is thereafter compared by comparator 6 with the respective standard values, from which a correction, or respectively update, of the standard values into updated values can be determined by element 7. In particular, the updated programmed disaggregation time is obtained from the correction. This is compared by comparator 8 with the running time, and as soon as the running time reaches the value of the updated programmed disaggregation time, initialization of the disaggregation and the transmission of a firing pulse I for disaggregating the projectile takes place at 9.

The purpose of the examples represented in FIG. 2 and FIG. 3 is to pre-program a fuse in a spin-stabilized projectile, fired from a gun, prior to the firing phase in such a way, that the disaggregation of the projectile into projectile fragments or into partial projectiles takes place after a defined length of flight, or respectively at a defined time, and thereafter to update this programming. The gun has an electronic gun arrangement, by means of which it is connected with a fire control device, not represented. In the usual way, the fire control device calculates the theoretical, or respectively standard, disaggregation time of the projectile fired from a gun tube of the gun. In connection with this calculation it is assumed that the muzzle velocity is the theoretical muzzle velocity. The final angle of twist can be the final angle of twist known from theory, or preferably the effective final angle of twist, wherein in the first case the correction of the final angle of twist has already been performed by the fire control device or the electronic gun arrangement. In accordance with the invention, a correction, or respectively update, of the programming of the disaggregation time is then performed by taking into consideration the actual muzzle velocity, or respectively frequency of rotation of the projectile and, if required, the actual measured final angle of spin.

The purpose of the example represented in FIG. 2 is to pre-program a fuse in a spin-stabilized projectile 100 fired from a gun 10 prior to the firing phase in such a way that the disaggregation of the projectile 100 into projectile fragments or into partial projectiles takes place after a defined length of flight, or respectively at a defined time. In this case the fuse is not provided with the velocity VT of the target. The gun 10 has an electronic gun arrangement 11, by means of which it is connected with a fire control device, not represented. In the usual way, the fire control device calculates the distance a between the gun 10 and the point of disaggregation of the projectile fired from a gun tube of the gun as a function of the velocity of the target. The theoretical length a of flight until the disaggregation time TPN of the projectile is calculated. In connection with this calculation it is assumed that the muzzle velocity is the theoretical muzzle velocity, or respectively standard muzzle velocity VO, and the final angle of twist is the theoretical final angle of twist e . The theoretical disaggregation time, or respectively length of flight until disaggregation, is transmitted to the gun 10 and forwarded via a coil driver 12 and a decoder 14 to a first counter, or respectively shift register 102 of the projectile 100, and is there memorized as the theoretical, or respectively pre-programmed length of flight, or respectively disaggregation time. An oscillator 106 is arranged on the projectile 100, or respectively its fuse, whose oscillating frequency fZ is considered to be constant. Furthermore, a coil 108 is arranged on the projectile 100, or respectively the fuse, in which the earth magnetic field H induces a voltage which is changed in a sine shape during the rotation of the projectile 100. This voltage is amplified by means of an amplifier 110, and the frequency of rotation fg of the projectile is determined from this. Then a calibration value is determined by calibration value determining element 112, which is equal to the quotient fz/fg (switch S2 open, switch S1 closed). In a further step, the oscillator frequency fz is divided at dividing element 116 by the calibration value, and thereafter the result of this division is divided at 117 by a previously determined step-down factor K1 at element 114 (switch 2 closed, switch 1 open). The result of this second division reaches a second counter 118 and is added up there during the flight time of the projectile. The following value is set in the counter 118 after T1 seconds:

$$T1*fg/K1=T1*fg*\pi*D/(tg(\phi e))=V0*T1=TPN*V0N$$

It results $$T1=TPN*VON/VO$$

and $$VON*TPN=VO*T1$$

With the aid of Antonio's equation, which is known to everyone skilled in the art, it can be demonstrated that this correction is right.

In the supersonic range, the following applies for the distance s1

$$s1=VO*TP/(1+a*VO*TP)$$

If VO*TP is replaced by VO*T1, it follows that $$s2=V0*T1/(1+a*V0*T1)=V0N*TPN/(1+a*V0N*TPN=s1$$

Since the product of VO and T1 is invariant, the circuit in accordance with FIG. 2 has made the right correction. The disaggregation distance is not changed.

It can be easily proven mathematically that for calculations in the case of the exemplary embodiment of FIG. 2, the oscillator frequency does not play a role, at least theoretically, which is cancelled out in the corresponding equations. The switch S1 remains open during the entire flight time. This means that the fuse cannot be interfered with.

During the entire flight time, (fg*TP)/k1 pulses are added up in the counter 118 and compared with the programmed time $TP_N$ in the memory 102. If both values are the same, a disaggregation signal X is generated at the output of the comparator 104.

The. following therefore applies for the length of flight:

$$TP*fg/K1=TP*(V0*tg(\phi e))/(\pi*D*k1)=TP*V0=TPN*VON$$

or, resolved in accordance with the projectile flight time TP:

$$TP=TPN*VON/VO.$$

The product of the flight time TP of the projectile and the muzzle velocity is invariant.

The above described device in accordance with FIG. 2 is suitable for executing the novel method in cases in which targets, which are stationary or move at comparatively slow speeds, are to be attacked, these are targets on the ground or possibly slow-moving flying targets, such as combat helicopters. The device described in what follows with reference to FIG. 3 is more elaborate in regard to its implementation than the device in accordance with FIG. 2, but is also suitable for cases in which rapidly approaching aerial targets must be attacked.

The design and functioning of the device in accordance with FIG. 3 are as follows: the fuse is provided with the velocity of the target VT. Programming of the fuse takes place first, wherein two switches, namely S1 and S2, are open. This programming is performed in that serially three clock pulses are transmitted to the fuse 200 from the fire control device, not represented, via the electronic gun arrangement, not represented, and the coil driver, not represented, and are deposited in three registers 202, 204, 206, namely:

$$\text{First pulse package: } K1=(tg(\phi e))/(\pi*D) \quad (16);$$

(see K1 from equation 15); basically this is the standard frequency of projectile rotation.

$$\text{Second pulse package: } K/K1=K*\pi*D/tg(\phi en)=K*\pi*D/tg(\phi e); \quad (17)$$

these are predetermined values.

Third pulse package: $TP_N$=the disaggregation time, or respectively standard disaggregation time calculated by means of the standard data.

K and K1 are factors used for taking into consideration certain variable values which, however, are fixed for respectively one firing. The factor K is determined by the fire control device. The factor K1 takes the final angle of twist $\phi e$ into consideration.

The following assumption is made for understanding the factor K: at the time TP=0, the distance between the projectile and the target is s. It is assumed that the projectile has a constant velocity VO, and the target has the velocity VT. The target and the projectile meet at the end of the time $TP_N$.

$$TPN*(VON+VT)=s \quad (18)$$

But the effective projectile velocity is VO. Therefore the following equation applies for T1:

$$s=T1*(VO+VT) \quad (19).$$

If s from the equations (18) and (19) is considered to be equal, the following applies for T1:

$$T1=TPN*(VON+VT)/(VO+VT). \quad (20)$$

If ΔV+VON are assumed for VO, the following follows from the equation (20):

$$T1=TPN*(VON+VT)/(\Delta V+VO+VT). \quad (21)$$

In the above equation, the numerator and the denominator are now divided by (VON+VT). If all higher terms are ignored, the following applies for T1:

$$T1=TPN*(1-\Delta V/(VON+VT)) \quad (22)$$

This correction equation can also be written in another form:

$$T1=TPN*(1-\Delta V/(V0N+VT))=T-\Delta V*(TPN/(VON+VT))=TPN-\Delta V*K \quad (23)$$

The following follows from equation (23) for K:

$$K=TPN/(VON+VT) \quad (24)$$

The exact disaggregation time T1 can be calculated in the fuse itself with the aid of the factor K; it is important that only known values for K are contained in equation (24).

The mathematical bases for determining the factor K can be found in published European Patent Applications Nos. EP-0 802 390-A; EP-0 802 391-A; and EP-0 802 392-A.

The layout of the fuse in accordance with FIG. 3 takes place with T1=TPN−ΔV*K, wherein the latter has to perform the following functions:

a) Determination of VO directly following firing b) Determination of ΔV from VO and VON c) Calculation of (−ΔV*K); K must be made known to the fuse d) Addition of the product (−ΔV*K) to the programmed time TPN.

It should be added here, that the fuse in accordance with FIG. 2 also calculates by means of a factor K, but this does not take the velocity of the target VT into consideration, so that VT=0, and is calculated in accordance with the following equation:

$$K=TPN/VON.$$

For explanation:

$$TP=TPN+\Delta V*K=TPN+TPN*\Delta V/V0N=TPN*(1+\Delta V/V0N)=TPN/(1-\Delta V/VON)=TPN*V0N/(V0N--\Delta V)=TPN*VON/VO$$

The functioning of the arrangement in FIG. 3 will now be further described in accordance with the above explanations regarding the factor K. After programming, which takes place first, the autonomous measurement for determining the effective muzzle velocity VO now follows as the second step, wherein the switch S1 is closed and the switch S2 open, by means of oscillator 205 and divisor 226. The actual muzzle velocity is a function of the final angle of twist. Since the value of the actual final angle of twist differs from the value of the standard final angle of twist, or respectively is different from gun tube to gun tube, it is necessary to determine it also and to include it in the calculations. The determination of this angle is preferably performed in advance, and a value with the actual final angle of twist is already entered into the register 204. The earth magnetic field H induces a voltage in the coil 208, which is amplified by means of the amplifier 220. Thereupon the value R1:

$$R1=\pi*D*fz/(tg(\phi e)*V0*5) \quad (25)$$

is obtained in a first counter 221. In the present case an oscillator 205 with a frequency of 5 MHz is used for determining the actual muzzle velocity, and a division by 5 takes place in a divisor 226.

The calculation of (VO*K1) now takes place as the third step, wherein the switch S1 is open and the switch S2 closed. The programmable divisor, which essentially includes a second counter 222 and a comparator 230, is started. The programmable divisor results in a step-down. The second counter 222 respectively counts up to the count of the first counter 221, after which a reset takes place and the second counter 222 is set to zero again. The serial result is added up in a third counter 223 during exactly 200 ms. This time of 200 ms is determined by a precision oscillator 228 at 4 kHz.

The count of the third counter 223 after 200 ms corresponds to the actual muzzle velocity, multiplied by the factor K, which is used in what follows. It is:

$$(fz/R1)*0.2=VO*K1 \quad (26)$$

R1 results from the equation (25).

Fourth, the determination of the difference between the standard muzzle velocity stored in the register 202 and the actual muzzle velocity determined by the autonomous measurement by the third counter 223 takes place with the aid of a subtraction stage 232, wherein the switches S1 and S2 are open. Actually, the difference between the velocities, multiplied by K1, is formed:

$$\text{Velocity difference}=K1*(VON-VO) \quad (27)$$

The result is available at the output of the subtraction stage.

In a fifth step, the multiplication of the just calculated difference velocity with the value K/K1, stored in the register 204, takes place in a multiplier 234, so that the factor K1 is eliminated. The result, which is available at the output register of the multiplier 234, is $$K1*(VON-VO)*K/K1=K*(VON-VO)=T \quad (28)$$

ΔT is the deviation of the updated programmed disaggregation time from the standard disaggregation time (see equation (24) for K).

In a sixth step, the result ΔT of the above multiplication is added in yet a further addition stage 236 at the time TPN, which is stored in the register 206. The following applies from this for the effective disaggregation time TP:

$$TP=TPN+K*(VON-VO) \quad (29)$$

Finally, in a seventh step the moment of disaggregation is determined. During TP seconds, the pulses of the 4 kHz oscillator 228 are added up in a fourth counter 224. The count of the fourth counter 224 is compared in a further comparator 238 with the determined value of the actual disaggregation time. As soon as the count of the fourth counter 224 corresponds to the actual disaggregation time from the addition stage 236, a pulse I for the disaggregation of the projectile is transmitted. To prevent that an undesired early disaggregation takes place, disaggregation is blocked during a safety period, for example for 200 ms, which is provided by the oscillator 228, or respectively the counter 224, via 240.

To prevent that, because of erroneous measured results, the initiation takes place at a time far ahead of the desired time for disaggregation, more than one measurement for determining the actual frequency of rotation fg of the projectile is performed during the calibration phase. The result of each measurement is subjected to a plausibility test, or it is only used further if it is confirmed by a further measurement.

What is claimed is:

1. A method for correction of event timing of an event (TP) in a spin-stabilized projectile fired from a muzzle, the method including measuring an actual rotation frequency of the projectile by rotation of the projectile in a magnetic field, calculating an actual muzzle velocity from the measured actual rotation frequency of the projectile, and calculating the correction of the event timing as a function of a deviation between of the actual muzzle velocity and a theoretical muzzle velocity;

wherein the improvement comprises:

calculating a chronologically-limited calibration interval, the calibration interval directly following firing of the projectile, said step of calculating the calibration interval comprising minimizing an overall error function;

taking a measurement of the actual rotation frequency during the calibration interval; and calculating the correction of the event based on the measurement during the calibration interval, wherein the step of minimizing an overall error function comprises:

determining a first relative error of a measurement method for measuring the actual rotation frequency of the projectile, wherein the first relative error is a function of a number of projectile rotations;

determining a second relative error in a distance traveled by the projectile during the calibration interval, wherein the second relative error is a function of the number of projectile rotations;

summing the first relative error and the second relative error to form an overall relative error (ϵ);

minimizing the overall relative error by differentiating the overall relative error, with respect to the number of projectile rotations, to obtain a first derivative of the overall relative error, setting the first derivative equal to zero, and solving to obtain an optimum number of projectile rotations ($R_{opt}$); and setting the calibration interval to include at least approximately the optimum number of rotations.

2. The method according to claim 1, comprising:

providing the projectile with a magnetic field sensor having an output varying with the actual rotation of the projectile, whereby a number of projectile rotations is detectable;

providing a fixed-frequency oscillator, wherein the measurement method for measuring the actual rotation frequency of the projectile comprises counting a number of pulses output from the fixed-frequency oscillator during a predetermined number of actual rotations of the projectile; and calculating the actual rotation frequency from the number of projectile rotations and the number of pulses.

3. The method according to claim 1, wherein the measurement method for measuring the actual rotation frequency of the projectile comprises counting a number of pulses output from a fixed-frequency oscillator during a predetermined number of actual rotations of the projectile, and wherein the first relative error is given by ΔM/M, where ΔM is a number of pulses not counted and M is the number of pulses output from the fixed-frequency oscillator.

4. The method according to claim 1, wherein the second relative error is given by Δs/s, where s is a theoretical distance traveled by the projectile and Δs is a difference between the theoretical distance traveled by the projectile and an actual distance traveled by the projectile.

5. The method according to claim 1, wherein the correction of the event timing comprises summing a stored theoretical event time and a calculated event time.

6. The method according to claim 5, including storing the calculated event time.

7. The method according to claim 6, wherein the magnetic field sensor includes at least one of a coil, a Hall element, or a field plate.

8. A method for correction of event timing of an event (TP) in a spin-stabilized projectile fired from a muzzle, the method including measuring an actual rotation frequency of the projectile by rotation of the projectile in a magnetic field, calculating an actual muzzle velocity from the measured actual rotation frequency of the projectile, and calculating the correction of the event timing as a function of a deviation between of the actual muzzle velocity and a theoretical muzzle velocity;

wherein the improvement comprises:

calculating a chronologically-limited calibration interval, the calibration interval directly following firing of the projectile;

taking a measurement of the actual rotation frequency during the calibration interval; and calculating the correction of the event based on the measurement during the calibration interval, and further wherein the step of calculating the actual muzzle velocity from the measured actual rotation frequency comprises determining an angular deviation between a final angle of twist and a theoretical angle of twist and calculating the actual muzzle velocity as a function of the angular deviation.

9. The method according to claim 1, wherein the event is a disaggregation.

10. The method according to claim 1, wherein the magnetic field is a magnetic field of the Earth.

11. The method according to claim 1, comprising:

performing measurements for determination of the actual rotation frequency;

subjecting each measurement to a plausibility test; and using each measurement only if it is confirmed by a later measurement.

12. The method according to claim 1, comprising a step of firing the projectile against a rapidly-approaching aerial target.

13. A projectile device for executing a method for correction of event timing of an event (TP) in a spin-stabilized projectile fired from a muzzle, the method including measuring an actual rotation frequency of the projectile by rotation of the projectile in a magnetic field, calculating an actual muzzle velocity from the measured actual rotation frequency of the projectile, and calculating the correction of the event timing as a function of a deviation between of the actual muzzle velocity and a theoretical muzzle velocity;

calculating a chronologically-limited calibration interval, the calibration interval directly following firing of the projectile;

taking a measurement of the actual rotation frequency during the calibration interval; and calculating the correction of the event based on the measurement during the calibration interval, wherein the projectile device comprises:

a memory for storing a theoretical event time calculated as a function of a theoretical rotation frequency;

an actual rotation frequency measuring apparatus;

a processor for correcting the theoretical event time, according to the actual rotation frequency, to obtain a calculated event time corresponding to the correction of event timing wherein the processor is adapted to carry out the steps of calculating the actual muzzle velocity and calculating the correction of the event time, and comprising a comparator for comparing running time with the calculated event time and initiating the event when the running time equals the calculated event time.

14. The projectile device according to claim 13, comprising a coil device adapted to have a voltage induced therein by the magnetic field, a fixed-frequency oscillator, and a device for forming a calibrating value from connected outputs of the coil device and the oscillator during the calibration interval.

15. A method for correction of event timing in a spin-stabilized projectile fired from a muzzle, the method including measuring an actual rotation frequency of the projectile by rotation of the projectile in a magnetic field, calculating an actual muzzle velocity from the measured actual rotation frequency of the projectile, and calculating the correction of the event timing as a function of a deviation between of the actual muzzle velocity and a theoretical muzzle velocity;

wherein the improvement comprises:

taking a measurement of the actual rotation frequency during a chronologically-limited calibration interval $R_{opt}$, the calibration interval directly following firing of the projectile; wherein $$R_{opt}^2=((t_g(\phi_e)/(\pi*D))^2*(2*V_0*\Delta M)/(fZ*(2a-k)).$$

* * * * *